US006520502B1

(12) United States Patent
Drouhard

(10) Patent No.: US 6,520,502 B1
(45) Date of Patent: Feb. 18, 2003

(54) BOARD GAME SUITABLE FOR PRIVATE OR CASINO PLAY

(76) Inventor: Timothy W. Drouhard, P.O. Box 20666, Canton, OH (US) 44701

( * ) Notice: Subject to any disclaimer, the term of this patent is extended or adjusted under 35 U.S.C. 154(b) by 0 days.

(21) Appl. No.: 09/717,557

(22) Filed: Nov. 21, 2000

Related U.S. Application Data

(60) Provisional application No. 60/167,151, filed on Nov. 23, 1999, and provisional application No. 60/167,166, filed on Nov. 23, 1999.

(51) Int. Cl.[7] ..... A63F 3/00
(52) U.S. Cl. ..... 273/242; 273/292; 273/274
(58) Field of Search ..... 273/242, 256, 273/274, 278, 292

(56) References Cited

U.S. PATENT DOCUMENTS 3,033,572 A * 5/1962 Thibault
4,682,777 A * 7/1987 Wood
4,878,675 A * 11/1989 Perry et al.
5,046,736 A * 9/1991 Bridgeman et al.
6,299,168 B1 * 10/2001 Tyson

* cited by examiner

*Primary Examiner*—William M. Pierce
(74) *Attorney, Agent, or Firm*—Sand & Sebolt

(57) ABSTRACT

A method of playing a board game in which each of the spaces in a track are depicted as one of the cards in a common deck of 52 playing cards. Players advance to landing spaces based on rolls of a pair of dice and then draw a card from a deck of playing cards. Points are awarded to the players based on predefined similarities between the landing space and the card drawn. In an alternate embodiment, each of the spaces in the track can be a representation of two possible numbers from 1 to 6. Players advance to landing spaces based on rolls of a pair of dice and points are awarded to the players based on predefined similarities between the numbers on the landing space and the outcome of the dice roll.

22 Claims, 2 Drawing Sheets

BOARD GAME SUITABLE FOR PRIVATE OR CASINO PLAY

This application claims benefit of Provisional Applications Ser. Nos. 60/167,151 filed Nov. 23, 1999 and Ser. No. 60/167,166 filed Nov. 23, 1999.

BACKGROUND OF THE INVENTION

1. Technical Field

The present invention relates to games and more particularly to board games.

2. Background Information

Board games have long been popular with both adults and children of a wide range of ages. Some adults, however, after having played board games in their younger years, become more interested in card games or dice games. The interest by such adults in many conventional board games may tend to wane. A need, therefore, exists for a board game which incorporates playing cards and/or dice in its rules and format.

As legalized gaming is adopted by an increasing number of jurisdictions, the success of such gaming endeavors may depend on providing patrons with new and enjoyable games. Heretofore, board games have not generally been adapted to such commercial gaming operations since the formats of many board games often seem quite remote from common card and dice casino games such as blackjack and craps. The formats of many board games may often, therefore, seem incongruent in a casino environment. A need exists, therefore, for a board game which in rules and format incorporates features of common casino card and dice games so as to be more enjoyable to patrons of such gaming operations.

SUMMARY OF THE INVENTION

It is an object of the present invention to provide a board game which in its rules and format incorporates conventional playing cards and/or dice.

It is a further object of the present invention to provide a board game which in its rules and format is adapted to be used in commercial gaming operations.

These and other objects are satisfied by the present invention which is a method of playing a board game which comprises the steps of providing a board having a starting position and a track comprising a plurality of spaces arranged in a series wherein each of at least some of said plurality of spaces corresponds to one card in a deck of cards. A deck of cards and a random number generator are also provided. A first player uses the random number generator to generate a first random number and causing said first player to advance a first marker on said track of spaces from a starting position by a first number of spaces corresponding to said first random number to position said first marker on a first landing space. The first player then draws a first card form the conventional deck of cards and compares this first card and the landing space. A first number of points is then awarded to the first player based on predefined similarities between this first card and the first occupied space. A second player then uses the random number generator to generate a second random number, and advances a second marker from the starting position on the track of spaces by a second number of spaces corresponding to the second random number to position said second marker on a second land space. The second player then draws a second card from the deck of cards, compares the second card and the second landing space. A second number of points is then awarded to the second player based on predefined similarities between the second card and the second landing space.

Also encompassed by the present invention is a method of playing a board game which comprises the steps of providing a board having a starting point and a track comprising a plurality of spaces arranged in a series. Each of at least some of said spaces has a pair of numerical representations. A random number generator is also provided, and the first player uses this random number generator to generate a first pair of random numbers, wherein this first pair of random numbers has a first total. The first player then advances a first marker from the starting point to a first landing space by the total of the first pair of random numbers. A first number of points is then awarded to the first player based on predefined similarities between the first pair of random numbers and the pair of numerical representation on the first landing space. The second player then uses the random number generator to generate a second pair of random numbers wherein the second pair of random numbers have a second total. The second player then advances a second marker by this total from the starting point to a second landing space. A second number of points is then awarded to the first player based on the predefined similarities between the second pair of random numbers and the pair of numerical representations on the second landing space.

BRIEF DESCRIPTION OF THE DRAWINGS

The preferred embodiment of the invention, illustrative of the best mode in which applicant contemplated applying the principles, is set forth in the following description and is shown in the drawings and is particularly and distinctly pointed out and set forth in the appended claims.

DESCRIPTION OF THE PREFERRED EMBODIMENTS

Figure 1:
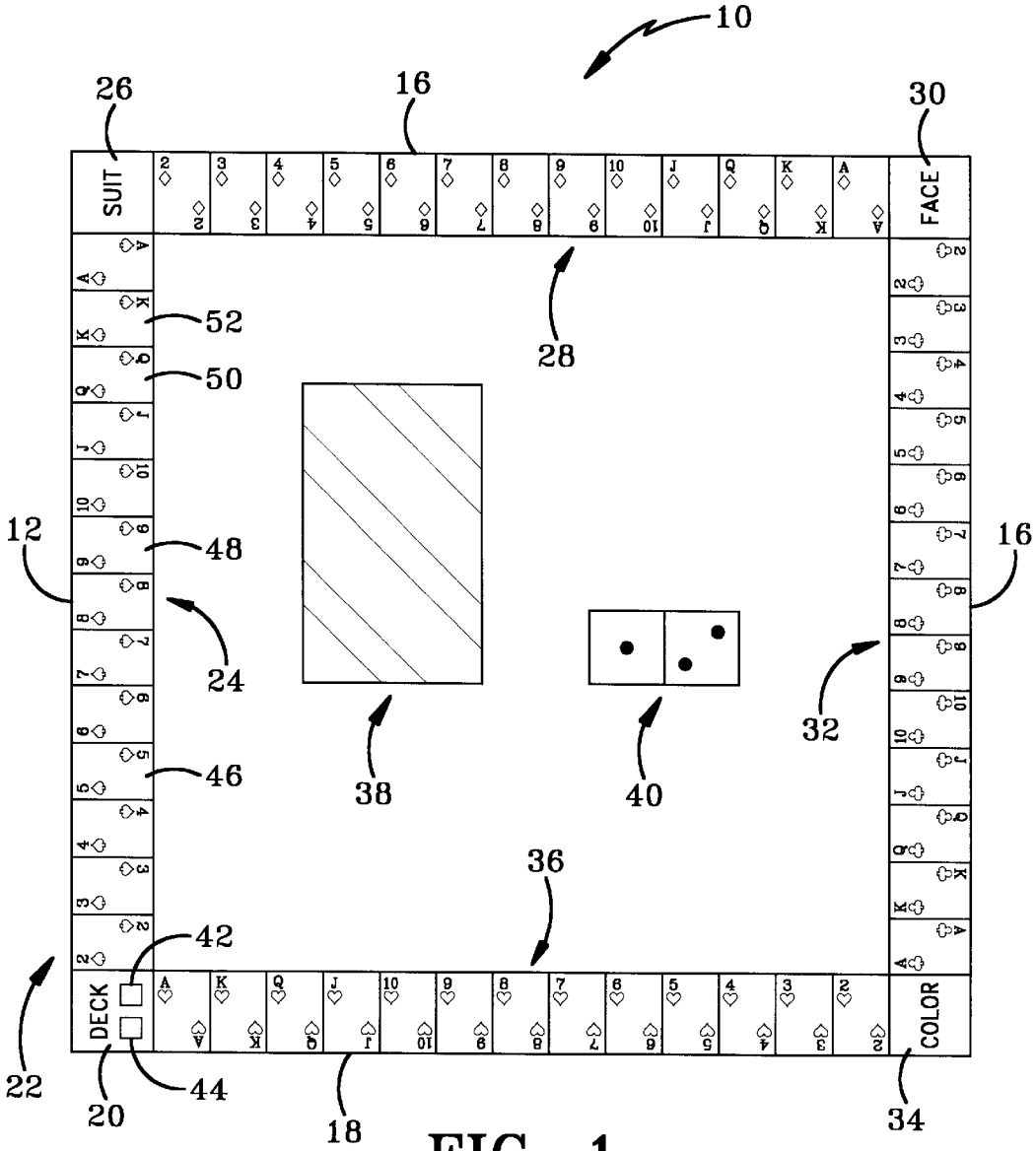
FIG. 1 is a plan view of a board on which a preferred embodiment of the game of the present invention may be played.

Referring to FIG. 1, the game is played on a square shaped board 10 which has sides 12, 14, 16, and 18. There is a starting position corner 20 which begins a track 22. The track 22 begins with a plurality of spaces 24 duplicating the cards in the spade suit of a common deck of 52 cards, beginning with the deuce of spade and arranged in ascending order to the ace of spaces. At the corner between sides 12 and 14 there is a suit corner space 26. Adjacent to side 14 of the board 10, there are a plurality of spaces 28, each duplicating one of the cards in the diamond suit and arranged from the deuce of diamonds in ascending order to the ace of diamonds. At the corner between side 14 and side 16, there is a face corner space 30. Adjacent side 16, there is a club plurality of spaces 32 which duplicate the club suit arranged from the deuce of clubs in ascending order to the ace of clubs, after which there is a color corner space 34 at the corner between sides 16 and 18. Adjacent side 18, there is a plurality of heart spaces 36 which duplicate the cards in the heart suit from the deuce of hearts in ascending order to the ace of hearts. A common deck of 52 playing cards 38 is provided as is a pair of common six-sided dice 40. Also provided is a movable first marker 42 and a second marker 44. The rules of the game are that each player in a plurality of players, positions a marker as at a first marker 42 for first player and a second marker 44 for a second player in the starting position corner space 20 (deck corner). The first player then throws the dice and advances the total amount shown by the dice 40, starting on the spade suit spaces 24. The player then draws a card from the deck of cards 38 which are positioned in a face down position. The card is then compared with the first space 46 and points are assigned based on Table 1. For example, if the first player lands on a first landing space 46, the first player would be awarded 100 points if the 5 of spades were drawn. For any number 5, the first player would be awarded 50 points; for any spade, 25 points would be awarded; for any club (other black card), 10 points would be awarded; and for all red cards (hearts and diamonds), 10 points would be deducted. The second player then throws the dice 40 and advances from the starting position corner 20 by the amount shown on the dice to a second landing space 48, e.g. a 9 would advance to the 9 of clubs. The second player then draws a card from the deck of cards 38 and compares the card drawn with the second space 48. Points are awarded to the second player based on Table 1. The first player then throws the dice 40 and moves the first marker 42 from the first space 46 to a first successive space 50, e.g. a 7 would advance to the queen of clubs. The first player then draws another card from the deck of cards 38 and compares that card to the successive space 50, and points are awarded to the first player based on Table 1. The second player then throws the dice 40 and moves the second marker 44 by the number of spaces shown on the dice to a second successive space 52, e.g. a 4 would advance to the king of clubs. The second player then draws a card from the deck of cards 38 and compares the drawn card with the second successive space 52 and is awarded points according to Table 1. If the player lands on the suit space corner 56, the face space corner 30, the color space corner 34, or the starting position corner space 20 (deck corner), the contingencies are different from the card spaces and are described in Table 1. These procedures will continue until one player obtains 5,200 points when that player will be declared the winner. For a fast game, a winner is declared when a player obtains 520 points.

In an alternate game, players may place bets on one or a plurality of spaces. The player draws a card. If the card matches a space exactly, the player wins a multiple of the bet, such as 20 times the bet. In this alternate game, end squares are not played.

TABLE 1

| Summary of Rules of First Embodiment |
|---|
| 1 Start at "deck" space corner. Face Spades. |
| 2. Roll dice and advance that amount of card squares on the board. |
| 3. Draw from deck:<br>If card is exact match to the card landed on, win 100 points.<br>If card is the same face as the card landed on, win 50 points.<br>If card is the same suit as the card landed on, win 25 points.<br>If the card is the same color as the card landed on, win 10 points.<br>If the card is the opposite color, lose 10 points. |
| 4. Do not play with jokers. |
| 5. When landing on suits space corner, player calls suit, then draws from deck; if card drawn matches player's call, win 25 points; if color of card drawn is same as card called, win 10 points; if opposite color, lose 10 points. |
| 6. When landing on face space corner, player calls a number and color, then draws from deck; if card drawn matchers player's call, win 50 points; if card matches player's call suit, wind 25 points; if card drawn matches player's call color, win 10 points; if opposite color, player loses 10 points. |
| 7. When landing on color space corner, player calls color, if a match, player wins 10 points; if opposite color, player loses 10 points. |
| 8. When landing on space corner, player calls next card up, then draws from deck; if card matches player's call exactly, win 100 points; if matches face, win 50 points; if matches suit, win 25 points; if matches color, win 10 points; if opposite color, lose 10 points. |
| 9. Place played cards face down. |
| 10. Reshuffle deck when last card is drawn. |
| 11. Total points to win, 5,200; fast game 520 points. |

Figure 2:
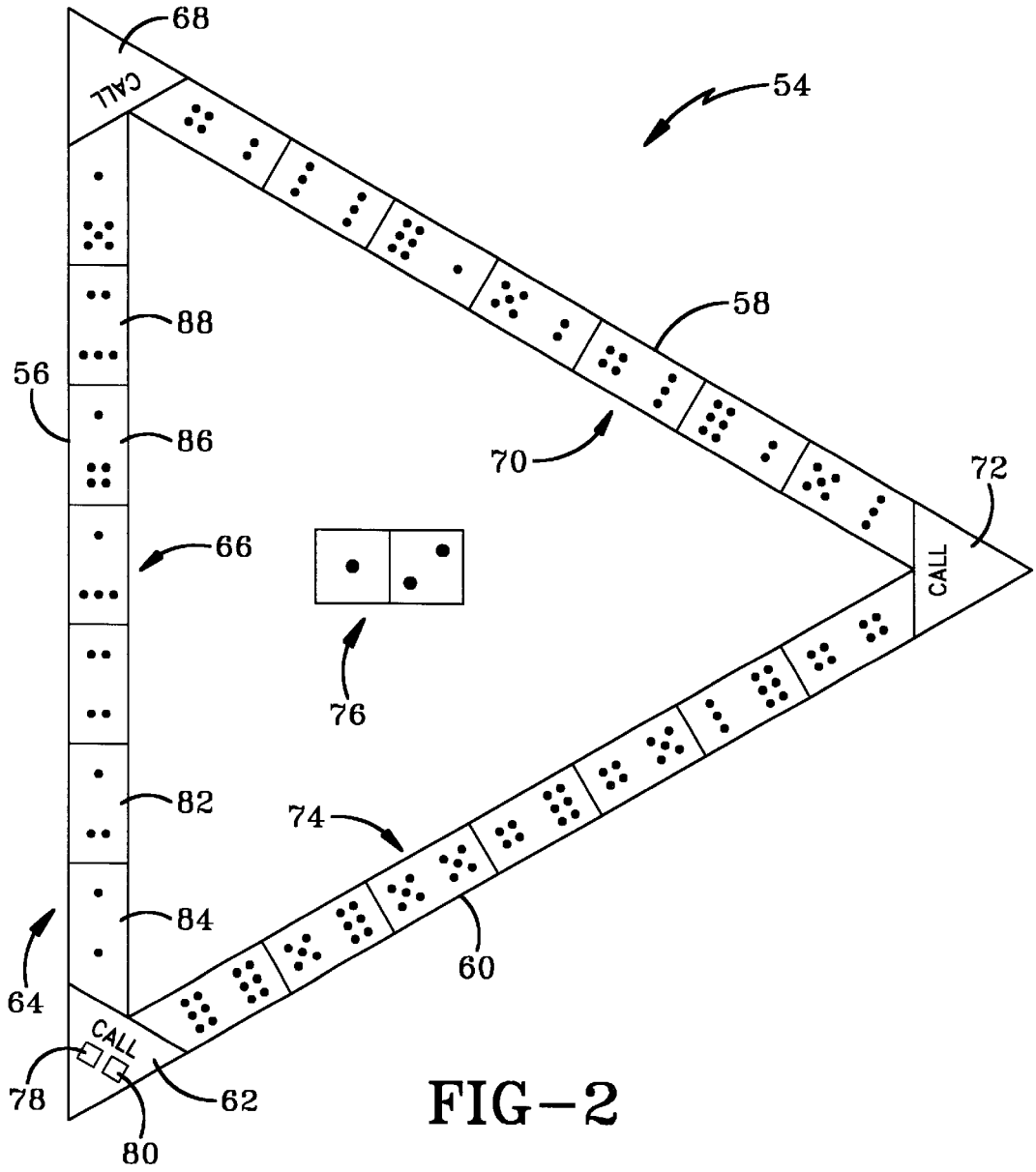
FIG. 2 is a plan view of a board on which an alternate preferred embodiment of the game of the present invention may be played.

Referring to FIG. 2, a board on which another embodiment of the game is played is a triangularly shaped board 54. This board has sides 56, 58 and 60 and a starting position call space 62 at one of its corners. As with the first embodiment, there is a track 64 of spaces. A first series of spaces 66 is adjacent side 56. Each space in this first series of spaces 66 has a representation of two integers wherein each of these integers from 1 to 6 inclusively. In the embodiment shown, these representations comprise dots which are arranged in the same way as the dots are arranged on the faces of common playing dice. At the end of the first series of spaces 66 there is a call space, and following this call space, there is a second series of spaces 70 which include spaces serially arranged wherein each of these spaces combination of two integers, and in this embodiment the integers are, again, represented by dots which are arranged in the same way as such dots are arranged on the faces of such common playing dice. At the end of the second series of spaces 70, there is a call space 72 and after this call space 72, there is a third series of spaces 74 adjacent side 60 of the triangularly shaped board 54. The spaces in the third series of spaces also have two integers which are represented in the same way that such integers are represented on the face of common playing dice. It will be observed from FIG. 2 that all possible combinations of dice throws are represented by one of the spaces in the track 64 and that these spaces proceed from the lowest possible numerical total, i.e. 2, to the highest possible numerical total, i.e. 12, for a throw of the dice. A pair of common six-sided playing dice 76 is also provided as is a first marker 78 and a second marker 80. As with the first embodiment, the game begins by having the first player throw the pair of dice 76 and move the first marker 78 by the total number shown on the faces of the dice 76. The first player then moves the first marker 78 to a first landing space 82, e.g. if a 2 is thrown. The dice 76 are then compared with the first landing space and points are awarded to the first player based on Table 2. The second player then throws the dice 76 and moves the second marker 80 by the amount showing on the dice 76 to a second space 84, e.g. if a 3 is thrown. Points are then awarded to the second player based on Table 2. The first player then throws the dice 76 and advances the first marker 78 from the first landing space 82 to a first successive space 86, e.g. if a 4 is thrown. The first successive space 86 is then compared with the displayed face of the dice 76 and points are awarded to the first player based on Table 2. The second player then throws the dice 76 and moves the second marker 80 by the amount showing on the dice 76 to a second successive space 88, e.g. if a 5 is thrown. Ordinarily the game will proceed until one player accumulates 2,100 points, and the player to first achieve this number of points will be declared the winner. In a fast game, the game will proceed until one of the players first achieves 210 points, and the player to achieve that number of points will be declared the winner. In an alternate game, the players may place wagers on any space or on a plurality of spaces. If a player lands on such a space and matches with his dice throw exactly, the player would be paid a multiple of his bet by a house entity as, for example, 5 times the bet.

TABLE 2

| Summary of Rules of Second Embodiment |
|---|
| 1. Start on "call" facing number "2". |
| 2. Roll dice. |
| 3. Advance amount of dice. |
| 4. If dice match the space landed on exactly, win 100 points; if amount is the same denomination; win 50 points; if no match but if the roll and block are in the same category (evens or odds), win 10 points; if not in the same category, lose 10 points. |
| 5. When player lands on "call" player rolls again after calling a number by its denomination; player wins or loses as stated above. |
| 6. Total points to win 2,100 points; fast game 210 points. |

While the above described embodiments of the game of the present invention are played by two players, it will be appreciated by those skilled in the art that these games may be played by a single player against, for example, a house entity in the case of a commercial gaming enterprise. It will also be appreciated that the games of the present invention may also be played by three or more players against each other in the way described in connection with the above described embodiments. It will also be appreciated that a plurality of players may also individually play these embodiments, with minor variations, against a house entity within the scope of this invention.

While the "jokers" from a common deck of playing cards are not used in the first embodiment disclosed above, those skilled in the art will appreciate that the "jokers" may readily be incorporated into the deck of cards for the playing of alternate embodiments of this game within the scope of the invention.

For the purposes of this disclosure, the term "board" means a conventional stiffened surface on which a board game may be played. This term is also intended to encompass any other surface, such as a gaming table or a video screen on which such games are commonly played by either mechanical or electronic means.

For the purposes of this disclosure, a "random number generating means" is any mechanical or electronic device or program which produces numbers in a substantially random manner. Unlimiting examples of the same include dice, spinning dials, pneumatic ball display devices and computer programs or routines.

A "deck of cards" means any plurality of paper cards or similar gaming devices each containing one or more insignia, representation or number which may be used in playing a game which includes, but is not limited to, the common deck of 52 playing cards having four suits of 13 cards in each of said four suits which are used in most common American card games such as poker and blackjack.

By the term "awarding points" what is meant is the function of either awarding a positive number of points, no points or a negative number of points.

It will be appreciated that a method of playing a board game has been described which incorporates common playing cards and/or dice into its format and which may be enjoyably played in either a home or a casino setting.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

Accordingly, the improved BOARD GAME SUITABLE FOR PRIVATE OR CASINO PLAY is simplified, provides an effective, safe, inexpensive, and efficient device which achieves all the numerated objectives, provides for eliminating difficulties encountered with prior devices, and solves problems and obtains new results in the art.

In the foregoing description, certain terms have been used for brevity, clearness, and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries, and principles of the invention, the manner in which the BOARD GAME SUITABLE FOR PRIVATE OR CASINO PLAY is constructed and used, the characteristics of the construction, and the advantageous new and useful results obtained; the new and useful structures, devices, elements, arrangements, parts, and combinations are set forth in the appended claims.

What is claimed is:

1. A method of playing a board game comprising the steps of:

(a) providing a board having a playing surface, the surface having indicia marked thereon showing a starting position and a track, the track beginning at the starting position and comprising a plurality of spaces marked on the playing surface, each space bearing the representation of one card of a deck of cards, the representations being arranged in sequential ascending order for a suit of cards; the track having at least two suits of sequentially ascending series of cards and further having at least one separator space positioned between the two suit series; the separator space bearing the representation of at least one of three characteristics of playing cards thereon;

(b) providing a deck of cards;

(c) providing a random number generator;

(d) providing at least a first marker adapted to be moved around the track to indicate a player's progress;

(e) generating a first random number with the random number generator;

(f) advancing the first marker on said track by a first number of spaces corresponding to the first random number from the starting position to a first landing space;

(g) drawing a first card from the deck of cards;

(h) comparing said first card and the representation on the first landing space; and (i) awarding a first number of points to a first player based on the comparison of the drawn card with the representation on the first landing space.

2. The method of claim 1 wherein the game is played between the first player and a second player which comprises the additional steps of:

(j) generating a second random number using the random number generator;

(k) advancing a second marker from said starting position on said track of spaces by a second number of spaces corresponding to the second random number to a second landing space;

(l) drawing a second card from the deck;

(m) comparing said second card and the representation on the second landing space; and (n) awarding a second number of points to said second player based on the comparison of the second card with the representation on the second landing space.

3. The method of claim 2 wherein additional steps are performed which comprise:

(o) generating a first further random number;

(p) advancing the first marker on said track of spaces by a further number of spaces corresponding to said first further random number to position said first marker on a first further landing space;

(q) drawing a first additional card from the deck of cards;

(r) comparing said first additional card with the representation on said first further landing space;

(s) awarding a first further number of points to said first player based on the comparison between the first card and the representation on the first landing space;

(t) generating a second further random number;

(u) advancing the second marker on said track of spaces by a second further number of spaces corresponding to the second further random number to position said second marker on a second further landing space;

(v) drawing a second additional card from the deck of cards;

(w) comparing said second additional card and said representation on said second further landing space; and (x) awarding a second further number of points to said second player based on the comparison between the second additional card and the representation on the second further landing space.

4. The method of claim 3 wherein steps (o) through (x) are repeated a plurality of times.

5. The method of claim 2 wherein a winner between the first player and the second player is declared based on a total number of points awarded to the first player and the second player.

6. The method of claim 3 wherein a winner between the first player and the second player is declared based on a total number of points awarded to the first player and the second player.

7. The method of claim 4 wherein a winner between the first player and the second player is declared based on a total number of points awarded to the first player and the second player.

8. The method of claim 7 wherein the deck of cards is a common deck of 52 playing cards having four suits of 13 cards in each of said 4 suits.

9. The method of claim 8 wherein there are at least 52 spaces and each of said 52 spaces corresponds to one and only one of the cards in said common deck of 52 cards.

10. The method of claim 9 wherein the board is a rectangular board having 4 sides and 4 corners and adjacent each of said 4 sides there are 13 lateral spaces corresponding to each card in said suit.

11. The method of claim 10 wherein there are 4 corner spaces on each of the 4 corners of the board, wherein at least one of said corners is a separator space, wherein if one of the first and second markers lands on the separator space, the method further includes the steps of:

reviewing the representation of card characteristics indicated on the separator space;

predicting the likelihood of a next drawn card exhibiting the identical characteristic to the representation on the separator space;

drawing the next card from the deck;

assigning points to the first or second player based on the accuracy of the prediction.

12. The method of claim 4 wherein each separator space bears the representation of one of three characteristics drawn from the group consisting of color, face value and suit; and when a player lands on a separator space the method further comprises the steps of:

reviewing the characteristic represented on the separator space;

predicting the likelihood of a next drawn card exhibiting an identical characteristic to the representation on the separator space;

drawing a next card from the deck;

comparing the next card with the characteristic represented on the separator space;

awarding points to the player based on the accuracy of their prediction.

13. The method of claim 1 wherein the random number generator comprises dice.

14. The method as defined in claim 1, wherein the suits of cards are arranged in sequential ascending order from a deuce through to a king.

15. The method as defined in claim 14, wherein the suits of cards are arranged in sequential ascending order from a deuce through to an ace.

16. The method as defined in claim 15, wherein the separator space bears the representation of one the characteristics of playing cards drawn from the group consisting of color, face value and suit.

17. A board for a board game, the board comprising a playing surface;

indicia marked on the playing surface, the indicia including:

a starting position;

a track, the track beginning at the starting position and comprising:

a plurality of spaces marked on the playing surface, each space bearing the representation of one card of a deck of playing cards, the representations being arranged in sequential ascending order for a suit of cards; the track having at least two suits of sequentially ascending series of cards;

at least one separator space positioned between the two suits of cards; the separator space bearing the representation of one of three characteristics of playing cards thereon.

18. The board as defined in claim 17, wherein the suits of cards are arranged in sequential ascending order from a deuce through to a king.

19. The board as defined in claim 18, wherein the suits of cards are arranged in sequential ascending order from a deuce through to an ace.

20. The board as defined in claim 19, wherein the separator space bears the representation of one the characteristics of playing cards drawn from the group consisting of color, face value and suit.

21. The board as defined in claim 20, wherein the board includes four suits of sequentially ascending series of cards, and each adjacent series of suits is separated by a separator space bearing the representation of one of three characteristics of playing cards.

22. The board as defined in claim 20, wherein the playing cards are a standard deck of cards having 52 cards therein with each suit having 13 cards.

* * * * *